US006266484B1

(12) United States Patent
Marchetti

(10) Patent No.: US 6,266,484 B1
(45) Date of Patent: Jul. 24, 2001

(54) WATER HEATER MADE OF PRESSURE-RESISTANT PLASTIC MATERIAL

(75) Inventor: Ruggero Marchetti, Fabriano (IT)

(73) Assignee: Merloni Termosanitari S.p.A., Fabriano (IT)

( * ) Notice: Subject to any disclaimer, the term of this patent is extended or adjusted under 35 U.S.C. 154(b) by 0 days.

(21) Appl. No.: 09/603,404

(22) Filed: Jun. 26, 2000

Related U.S. Application Data

(63) Continuation of application No. PCT/EP98/07982, filed on Dec. 8, 1998.

(30) Foreign Application Priority Data

Dec. 29, 1997 (IT) ..... MO97A0240

(51) Int. Cl.[7] ..... H05B 3/78; F24H 1/20
(52) U.S. Cl. ..... 392/447; 392/441; 392/449
(58) Field of Search ..... 392/441, 447, 392/449, 450, 451, 497, 503

(56) References Cited

U.S. PATENT DOCUMENTS

| | | | | |
|---|---|---|---|---|
| 4,865,014 | * | 9/1989 | Nelson | 126/361 |
| 4,982,856 | * | 1/1991 | Stokes | 220/3 |
| 5,167,344 | * | 12/1992 | Van Schilt | 220/657 |
| 5,668,922 | * | 9/1997 | Ross et al. | 392/441 |

* cited by examiner

*Primary Examiner*—Teresa Walberg
*Assistant Examiner*—Thor Campbell
(74) *Attorney, Agent, or Firm*—Thomas R. Vigil

(57) ABSTRACT

A water heater made of plastic material comprises an external case (7) and a main body (2) including two semi-shells (2*a*,2*b*) soldered to create a body which can withstand temperature and pressure. The two semi-shells (2*a*, 2*b*), each of which is fitted with radial reinforcing elements (8) and the external case (7), are made of compatible and recyclable thermoplastic materials, in particular mixtures of polymers reinforced with glass fibers, preferably in a percentage equal to or higher than 30%.

8 Claims, 3 Drawing Sheets

WATER HEATER MADE OF PRESSURE-RESISTANT PLASTIC MATERIAL

This application is a continuation of PCT/EP98/07982 filed Dec. 8, 1998.

TECHNICAL FIELD

The present invention relates to the field of apparatus for water heating or water heaters. The invention herein has been designed with special reference to electric water heaters, in particular those made of plastic materials.

BACKGROUND ART

Plastic materials are generally used for building water heaters of the type mentioned above, in order to avoid the drawbacks of traditional apparatus comprised of metal tanks which need to be specially arranged to withstand corrosion.

Document E2-A-0 674 139 shows a water heater made by joining two shells of a single plastic material, in particular polypropylene.

Document FR-A-2 620 803 shows a water heater with a shell of thermoinsulating expanded material, coated with a polyurethane foam jacket.

All water heaters of a known type mentioned above have a small capacity and cannot stand high pressures, for example operating pressures of 8 bar, at temperatures of up to 90°–100°. They can stand, however, peak pressures of at least 16 bars as required by the field regulations in force. In addition, water heaters of a known type need to be made with rather thick layers of insulating expanded material in order to avoid a rapid loss of heat towards the outside.

DISCLOSURE OF INVENTION

The aim of the present invention is to overcome the drawbacks of the prior art technique, providing a water heater wherein the structural characteristics of the two semi-shells and the relevant joining method, as well as the materials they are made of, contribute to obtain characteristics of high mechanical resistance and reliability in time also whenever high pressures arc present.

Another aim of the present invention is to build a water heater that does not need a supplementary insulating layer besides the shells.

A further aim of the present invention is to build a water heater that can be easily recycled and whose components are made of highly compatible plastic materials.

A still further aim of the present invention is to produce a water heater which is easy and cheap to build.

In order to achieve the aforementioned aim, the invention relates to a water heater of the type mentioned in the preamble of the present description, bearing the features illustrated in the following claims.

Further characteristics and advantages of the present invention will better emerge from the detailed description of a preferred embodiment that follows, in the form of a non limiting example, with particular reference to the figures of the accompanying drawings, in which.

Figure 1:
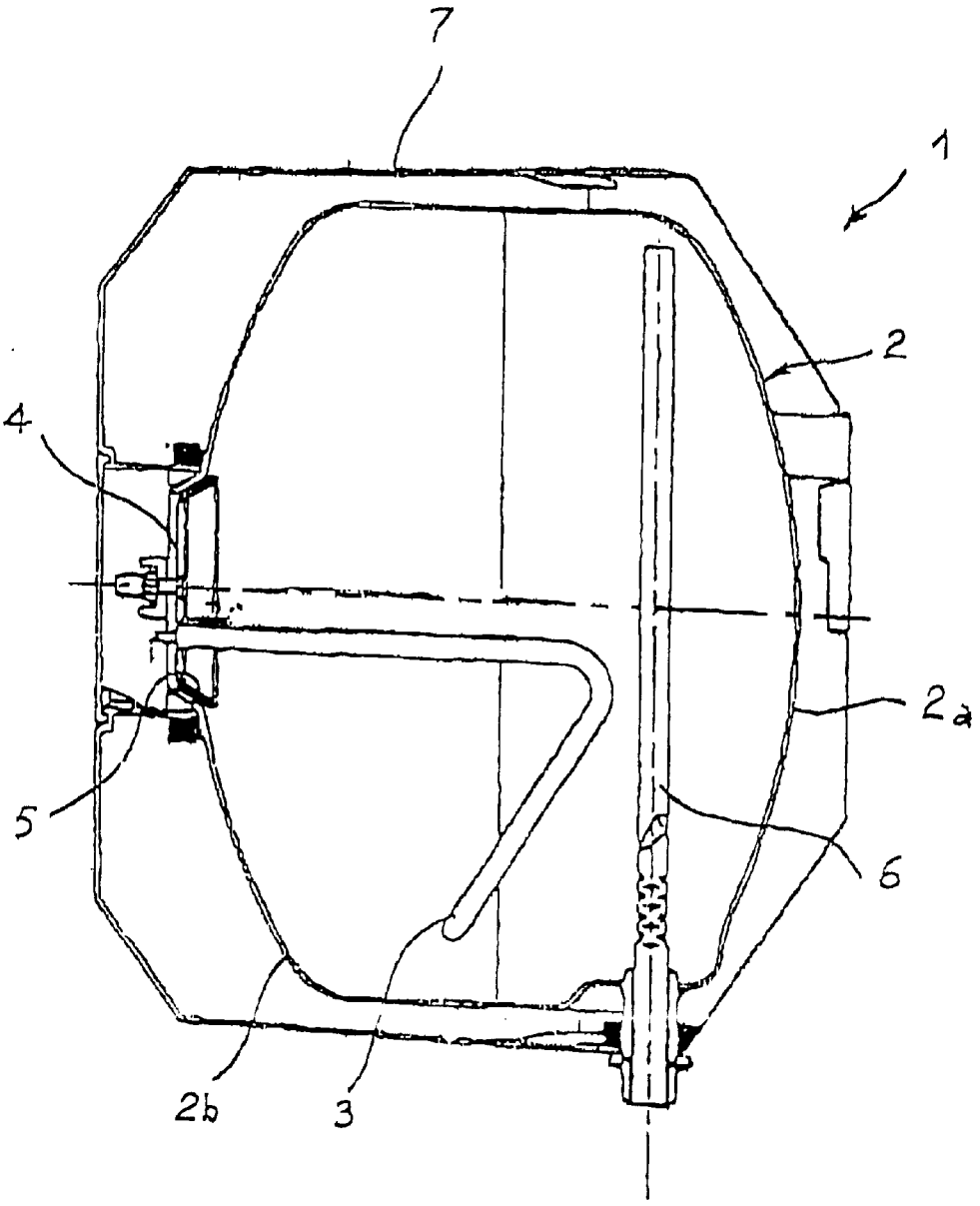
FIG. 1 is a schematic cross section of a water heater built according to the present invention.

With reference to FIG. 1, a water heater 1 made of plastic material resistant to relatively high pressures is comprised of a main body 2 consisting of two semi-shells 2*a*, 2*b*, wherein an electrical heating 3 is to be found which is fixed to a flange 4 mounted so as to cover an opening 5 on one of the two semi-shells 2*a*. Ducts 6 flow into the main body for feeding water in and out of the water heater 1. An external box 7, which has mainly an aesthetic function, encloses the main body 2.

Figure 2:
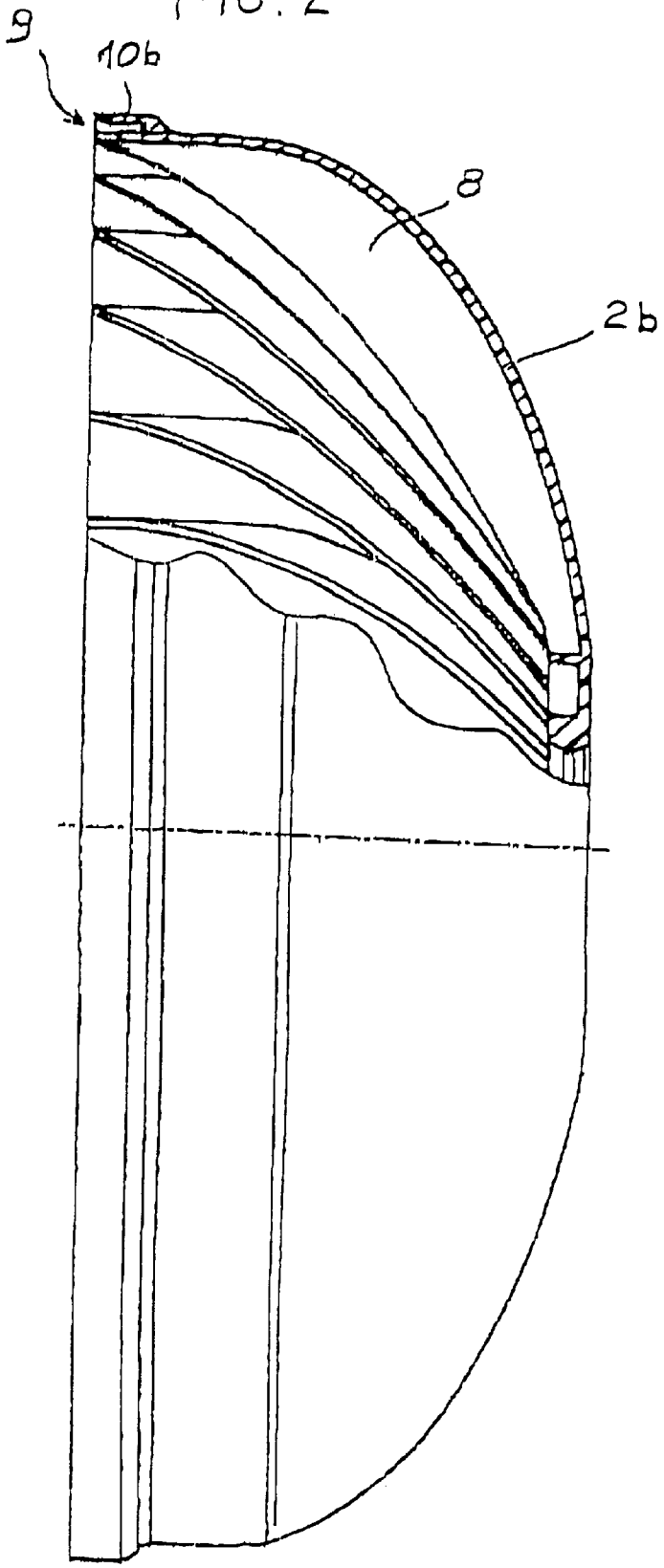
FIG. 2 is a lateral view, partially in section, of one of the two semi-shells belonging to the water heater of FIG. 1.
Figure 3:
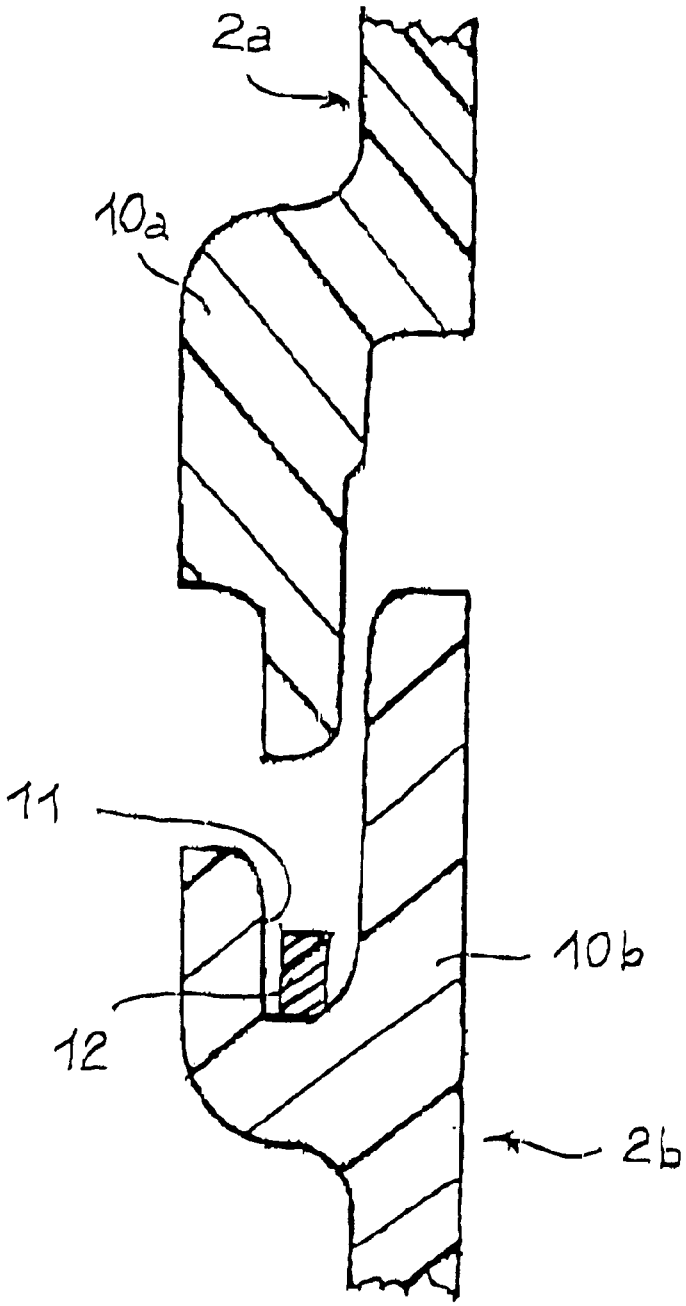
FIG. 3 is a section, in a larger scale, of the borders of the two semi-shells positioned one next to the other before they are joined together.

As may be observed in FIG. 2, each semi-shell 2*a*, 2*b* has a flattened cap shape and is entirely reinforced by a plurality of radial ribs 8. Along the periphery 9 of each semi-shell complementary joining belts l0*a*, 10*b* have been made for grafting into one another, as it is better shown in FIG. 3. In a preferred embodiment of the present invention, a joining belt 10*b* comprises a groove 11 within which it is possible to house a ring 12 of connecting material for constraining the two semi-shells 2*a*, 2*b* so as to form the main body 2. In particular, the joining belts 10*a*, 10*b* co-operate to form a cord of plastic material the thickness of which is bigger than the average thickness of each semi-shell.

The two semi-shells 2*a*, 2*b* are made of thermoplastic material, selected in order to ensure a high mechanical resistance and a low transmission of heat of the main body 2. The use of thermoplastic material ensures the total recyclability of the water heater 1, once the only flange 4 bearing the electrical heating element 3 has been disassembled. For this purpose, the ducts 6 too can be made of thermoplastic or of a thermosetting material. In the latter case, although the ducts 6 cannot be recycled as such, they can, however, be ground in the recycling process together with the main body 2 and remain, therefore, present as a charge in the thermoplastic material which the two semi-shells 2*a*, 2*b* are made of.

The materials listed hereinafter are particularly suitable for the construction of the water heater which is the subject of the present invention, with particular reference to their characteristics which allow them to be easily worked at temperatures which are higher than the max. operating ones of the water heater (about 90°–100°C.), to their high resistance to use, their low permeability to water and their temperatures of vitreous transition which are definitely higher, at least by 50°C., than the operating ones.

For instance, it has been demonstrated that the PPE/PPO (polyphenyletherpolypheniloxide) offers several possibilities to bind, at various percentages, materials such as PS (polystyrene), PA (polyamides), PBT (polybutylenterephtalate), PEK (polyacrylic ketone ethers), so as to create alloys which can be worked at temperatures which are by far higher than the typical operating temperatures of water heaters equal to about 90°–100°C. max. Some of the materials that have been detected as having appropriate workability and resistance characteristics are discussed hereinafter.

The mixtures of PPE and PS offer good workability and are resistant to episodes of oxidative degradation.

The presence of polystyrene can determine, in some cases, the risk of stress cracks, which can be adjusted with appropriate percentages of PS. From this point of view, better characteristics are offered by the mixtures of dried PPE/PA 6.6 or by the mixtures of PPE/PBT. These are characterised by a higher resistance to internal tension cracks than PPE, cracks which could involve breaks in the event—to be envisaged—of repeated and cyclic loads.

Said mixtures, therefore, are more suitable for application in the production of a water heater according to the present invention.

The materials mentioned above reach the envisaged purposes when they contain a percentage of glass fibers which is generally equal to or higher than 30%, according to the mixtures and the type of polymer which they contain.

In addition, the presence of glass fibers ensures a reduced water absorption till saturation of the plastic material, which is generally lower than approximately 3%.

A major characteristic of the present invention is represented by the compatibility of the materials with which the component parts of the water heater are made. In particular, the following groups of materials have been detected which are characterised by a good compatibility for the production of the shell (which must withstand temperature and pressure), of the external box or case 7 (which must be light, cheap and easy to work), and of a possible insulating layer (not illustrated in the figures) positioned between the shell and the external box.

Group A) shell made of a mixture of PPE and PS reinforced with glass fibers, external case made of PS (with mineral charges) and possible insulating layer made of EPS (expanded polystyrene);

Group B) shell made of a mixture of PPE and PA 6/6 reinforced with glass fibers, case made of PA 6/6 (with mineral charges) and possible insulating layer made of EPA 6/6 (expanded PA 6/6);

Group C) shell made of a mixture of PPE and PBT reinforced with glass fibers, case made of PBT (with mineral charges) and possible insulating layer made of expanded PBT;

Group D) shell made of PA 6/6 reinforced with glass fibers, case made of PA 6/6 (with mineral charges) and possible insulating layer made of EPA 6/6 (expanded PA 6/6);

Group E) shell made of PET (polyethylentherephtalate) reinforced with glass fibers in a percentage equal to or higher than 30%, case made of PET (with mineral charges) and possible insulating layer made of expanded PET;

Group F) shell made of PP reinforced with glass fibers in a percentage equal to or higher than 30%, case made of PP (with mineral charges) and possible insulating layer made of expanded PP.

The latter group of materials, in particular, is used for manufacturing water heaters of a lower class, which are subject to operating pressures not generally exceeding 3–4 ibar.

The insulated layer which can be possibly placed between the shell and the external case can be made, in particular, by an expanded polymer compatible with those forming the shell and the external case. As an alternative, the insulating material is constituted of a thermoformed layer which, from an initial flat slab, wraps the shell of the water heater. Further embodiments of the insulating layer envisage;

a sintered layer with expanded gains, an injection moulded layer with in-mould-foaming and a shape suitable for covering the shell, or an expanded layer injected by coextrusion, applied inside or outside the shell by using printing lines of a known type with two extruders.

Since tecnopolymers, that is the mixtures of polymers used for making the shell, have a high quality and intrinsic value, it is necessary and convenient that they are entirely recycled in order to be used again for manufacturing new products. Said entire recyclability is ensured by the compatibility of the materials used for manufacturing the other water heater components, as mentioned in the groups above.

In order to increase the insulating features of the main body 2, it is possible, therefore, to make an external skin for each semi-shell 2*a*, 2*b* by using coextrusion techniques of a generally known type or by surface taping the semi-shells 2*a*, 2*b*.

The special shaping of the joining belts 10*a*, 10*b* makes it possible, once these have been soldered together with techniques of a generally known type in the field of plastic materials, to perform a soldering between the two semi-shells 2*a*, 2*b* which is particularly resistant to deformations caused by the pressure inside the water heater.

In a further embodiment of the water heater described above, the two semi-shells 2*a*, 2*b* are distanced from one another by a generally tubular band, the opposed circular peripheral borders of which comprise joining belts respectively analogous with the joining belts 10*a*, 10*b* of the semi-shells 2*a*, 2*b* so as to enable the soldering of the latter to the ends of the tubular band, thus creating water heaters with different capacity, the semi-shells 2*a*, 2*b* being of equal dimension.

Obviously, by maintaining the principle of the present invention, various embodiments are possible and the relevant details can be varied widely with respect to this description and its illustration without falling outside the field of the present invention.

What is claimed is:

1. A water heater made of plastic material, comprising a main body (2) including two semi-shells (2*a*, 2*b*), an opening (5) being made on the main body for inserting a heating element (3), wherein each semi-shell (2*a*, 2*b*) includes a peripheral border (9) with coupling means (10*a*, 10*b*) which can be reciprocally coupled to form a band with higher resistance, radial reinforcing elements (8) extending from each peripheral border (9) to converge into a central area of each semi-shell (2*a*, 2*b*).

2. A water heater according to claim 1, wherein the radial reinforcing elements (8) are ribs protruding inside each semi-shell (2*a*, 2*b*).

3. A water heater according to claim 1, wherein water supply ducts (6) made of plastic material are found inside the main body.

4. A water heater according to claim 3, wherein the ducts (6) are made of thermosetting material.

5. A water heater according to claim 1, characterised in that it comprises an external box (7) separated from the main body (2) by an air space.

6. A water heater according to claim 5, wherein the external box (7) is made of thermoplastic material.

7. A water heater according to claim 1, characterised in that it contains a thin layer of plastic material for covering the main body, applied either by taping or by coextrusion.

8. A water heater according to claim 1, wherein the coupling means (10*a*, 10*b*) comprise joining belts which are complementary to one another, at least one of the two joining belts (10*b*) comprising an annular groove (11) for the housing, during the welding process of the semi-shells (2*a*, 2*b*), of a welding material (12).

* * * * *